United States Patent [19]

Stern

[11] Patent Number: 4,662,998

[45] Date of Patent: May 5, 1987

[54] ELECTRODEPOSITION OF REFRACTORY METAL SILICIDES

[75] Inventor: Kurt H. Stern, Takoma Park, Md.

[73] Assignee: The United States of America as represented by the Secretary of the Navy, Washington, D.C.

[21] Appl. No.: 808,326

[22] Filed: Dec. 12, 1985

[51] Int. Cl.[4] ..... C25D 3/66

[52] U.S. Cl. ..... 204/39; 204/231

[58] Field of Search ..... 204/39, 61, 71, 231

[56] References Cited

U.S. PATENT DOCUMENTS

| | | | |
|---|---|---|---|
| Re. 25,630 | 8/1964 | Cook | 204/39 |
| 2,936,268 | 5/1960 | Stern et al. | 204/61 |
| 2,950,233 | 8/1960 | Steinberg et al. | 204/39 X |
| 3,444,058 | 5/1969 | Mellors et al. | 204/71 |
| 3,814,673 | 6/1974 | Cook | 204/39 |
| 4,430,170 | 2/1984 | Stern | 204/39 |

FOREIGN PATENT DOCUMENTS

| | | | |
|---|---|---|---|
| 772672 | 11/1934 | France | 204/71 |
| 264696 | 6/1970 | U.S.S.R. | 204/61 |

OTHER PUBLICATIONS

Clifford A. Hampel, "The Encyclopedia of Electrochemistry", pp. 985–986, (1964).

*Primary Examiner*—G. L. Kaplan

*Attorney, Agent, or Firm*—Sol Sheinbein; Andrew M. Lesniak

[57] ABSTRACT

A refractory metal silicide coating is electrodeposited onto an object, using a bath containing an alkali fluoride melt, a silicon fluoride dissolved in the melt, a refractory metal-containing compound also dissolved in the melt. An anode composed of the refractory metal is immersed in the bath. The article to be coated is immersed in the bath as the cathode, a platinum electrode is immersed in the bath, and a voltage is applied between the cathode and platinum electrode until the coating obtains the desired thickness. By this process, coatings such as tantalum silicide and titanium silicide having a desired stoichiometric composition may be deposited on the surface of an object.

16 Claims, No Drawings

ELECTRODEPOSITION OF REFRACTORY METAL SILICIDES

BACKGROUND OF THE INVENTION

This invention relates to electrodeposition and more particularly to the electrodeposition of refractory metal silicides.

The advantages which greater hardness in metals offers is well recognized. Harder metals, more resistant to wear, reduce the need for frequent and costly replacement of parts.

Abrasive wear afflicts all manner of machinery in which metal surfaces contact other surfaces. For example, erosive wear plagues metals exposed to high velocity gas streams carrying hard particles, as in coal gasification, or even the lower velocity, liquid-entrained coal particles in a slurry flowing through a pipeline. The wearing of metals is frequently aggravated by high temperatures which lead to simultaneous metal oxidation, particularly in the newer energy industries.

Several approaches to reducing wear have been taken. Chief among these has been the formulation of ever harder alloys, such as the newer ones based on cobalt. Another route has been to modify only surface properties, rather than the bulk of the metal. This has been done by covering the bulk metal with a coating of another alloy. Still another method has been to modify the surface layer of the metal either by diffusing other metals into the surface (metalliding), by ion implantation, or by laser melting.

It has long been recognized that refractory silicides possess precisely the desirable hardness missing from metals and are stable at high temperatures. Nevertheless, such refractory silicides lack the desirable ductility of metals. Consequently there have been many attempts to combine the two in order to gain hardness combined with ductility. One approach has been to produce silicide coatings on metals. However, existing coating methods have not been entirely successful. Plasma spraying, which involves impinging the silicide powder on the surface to be coated, requires temperatures near 1500° C., is line-of-sight, and tends to produce somewhat porous coatings. Chemical vapor deposition can be carried out by combining two reactive gases so that the silicide reaction product is produced as a coating. Much development work has been done on this process, but the coatings are usually quite thin. Further, neither plasma spraying nor chemical vapor deposition allows any control over the stoichiometry of the coating.

During the 1960's, Senderoff and Mellors in "Coherent Coatings of Refractory Metals" *Science* (1966) volume 153, pages 1475–1481, incorporated herein by reference, showed that excellent coatings of the refractory metals could be electroplated from the ternary eutectic of (Li, Na, K) F by adding the metal as a complex fluoride, and plating between the appropriate metal anode and the cathode to be plated at 750° C.–800° C. Dense, adherent, and ductile plates were obtained, and there seemed to be no upper limit to the plating thickness; in fact, the substrate could be dissolved away to produce freestanding refactory metal objects.

Refractory metal carbide coatings have been electrodeposited as disclosed in U.S. Pat. No. 4,430,170, to Stern. Hard adherent coatings of any desired thickness were formed. The process comprises adding the refractory metal as a complex fluoride and the carbon as an alkali carbonate to an alkali fluoride melt. An anode comprised of the refractory metal and a cathode comprised of the article to be coated are immersed in the melt. When a voltage is applied across the cathode and anode the carbon and metal cations are simultaneously reduced at the cathode to form a refractory metal carbide coating.

Silicide coatings on metal articles have been formed by metalliding as disclosed in U.S. Pat. No. Re. 25,630 to Cook. In the metalliding process, silicon is added to a fused complex metal salt bath as silicofluoride. The silicon is dissolved in the bath and the metal article to be coated is immersed in the bath. The silicon diffuses into the metal and reacts with the metal to form a silicide coating. This process forms a non uniform coating wherein the concentration of silicon is the highest at the surface of the metal. In addition the rate at which the silicon diffuses into the metal decreases with time the result of which is that the process slows down as the thickness of the coating increases.

OBJECTS OF THE INVENTION

It is therefore an object of the present invention to protect metal surfaces of any shape from abrasive and erosive wear.

Another object of this invention is to provide a process for producing a hard, dense, adherent coating of any desired thickness of a refractory metal silicide.

A further object of this invention is to provide a process for producing a coating of a refractory metal silicide whereby the stoichiometry of the metal silicide coating produced can be controlled.

SUMMARY OF THE INVENTION

These and other objects are achieved by electrodepositing a coating of a refractory metal silicide from a solution of a desired refractory metal fluoride in a molten alkali fluoride-silicon fluoride mixture. An anode comprised of the desired refractory metal or silicon, a cathode comprised of the object to be coated and a platinum reference electrode are immersed in the melt. When a voltage is applied between the platinum electrode and the cathode the silicon and the refractory metal cations in the solution are simultaneously reduced at the cathode to form a metal silicide coating upon the object.

DESCRIPTION OF THE PREFERRED EMBODIMENT

To carry out the process of this invention, an essentially pure alkali fluoride melt is first prepared and held under a flowing inert atmosphere in a sealed cell. Silicon is added to the melt in the form of silicon fluoride ($K_2SiF_6$) and the refractory metal to be electrodeposited is added to the melt in the form of a soluble metal fluoride. An elemental form of silicon or the refractory metal is placed in the melt as the anode. The object to be coated is placed into the melt as the cathode. A platinum wire is placed into the melt as the reference electrode. Electrolysis is then carried out potentiostatically in the traditional manner until the object has the desired thickness of coating on its surface. Virtually any thickness of coating may be deposited by the process of this invention.

Preferably, the alkali fluoride melt is composed of a eutectic mixture of more than one alkali fluoride. Examples of such melts include, but are not limited to the eutectic mixtures KF: LiF; NaF: KF; NAF: LiF; and LiF: NaF:KF (herein after FLINAK). Most preferable, the melt is composed of FLINAK. In accordance with established methods, the melt should be essentially pure and dry. Impurities can be removed from the FLINAK by well known methods such as pre-electrolysis. To prevent impurities from entering into the system, electrodeposition is carried out in a water-free and oxygen-free slow-flowing inert atmosphere typically of argon, in accordance with established methods. Since alkali fluorides generally have high vapor pressures, the use of a vacuum during electrodeposition rather than an inert gas is not recommended.

To reduce the amount of diffusion of silicon into the cathode metal the cathode should be comprised of a metal which does not alloy with silicon. If a metal which does alloy with silicon is used, a prior coating of a metal which does not alloy with the cathode metal may be electrodeposited according to methods well known in the art as a barrier layer to eliminate this problem. For example, tantalum barrier layer may be used where a tantalum silicide coating is desired.

The preferred source of silicon is $K_2SiF_6$. Preferably, anywhere from about 5–10 weight percent silicon ion, based on the weight of the alkali fluoride melt can be added in the mixture.

The silicide of any refractory metal should be capable of being electrodeposited. Of course, certain routine and conventional adjustments to parameters such as voltage, temperature, percentage of silicon and percentage of metal containing compound, may be required. The preferred refractory metals to be used are tantalum, titanium, tungsten, molybdenum, chromium, hafnium, niobium and zirconium. The preferred metal containing compound is a refractory metal fluoride. Most preferably it is $K_2TaF_7$ where a tantalum silicide coatings is desired, and $K_2TiF_7$ where a titanium silicide coating is desired. The anode is comprised of the refractory metal or silicon, e.g. a tantalum or silicon anode is used where a tantalum silicide coating is desired and a titanium or silicon anode is used where a titanium silicide coating is desired.

The voltage applied is not critical to successful deposition. However, too high a voltage may cause decomposition of the fluoride melt. Generally, voltages below 1.2 volts are preferred. Current density merely controls the rate of coating deposition.

The temperature must be well above the melting point of the melt and is preferably above about 750° C. Temperatures over about 850° C. may interfere with deposition by increasing the evaporation rate of various components of the mixture. However, this difficulty may be overcome by the use of a pressurized, inert atmosphere.

Having fully described the invention claimed herein, the following example are provided to further illustrate the principles of the disclosed invention and are not intended to limit the scope of the invention in any manner.

EXAMPLES 1–4

A FLINAK melt was prepared and placed in a nickel container $K_2TaF_7$ and $K_2SiF_6$ were added to the FLINAK melt. The composition of the melt was varied by additions of $K_2TaF_7$ and $K_2SiF_6$ beginning with 0.037 moles of each in 200 g FLINAK (Ta: Si =1.0), and increasing this ratio to 2:5 by addition of $K_2TaF_7$. At each composition ratio the open circuit voltage (O.C.V.) was measured until it became constant Two nickel coupons were then plated at different voltages. All of the above operations were carried out at the voltages shown in Table 1 and 10–20 mV/cm$^2$ for about an hour. The results are summarized in Table 1.

TABLE I

| Example No. | Ta:Si (in melt) | mV[a] |
|---|---|---|
| 1 | 1:0 | −100 |
| | | −150 |
| 2 | 5:3 | −100 |
| | | −200 |
| 3 | 2:0 | −100 |
| | | −200 |
| 4 | 2:5 | −100 |
| | | −200 |

[a]Cathodic voltage relative to the O.C.V.

Obviously many modifications and variations of the present invention are possible in the light of the above teachings. It is therefore to be understood that, within the scope of the appended claims, the invention may be practiced otherwise than as specifically described.

What is claimed and desired to be secured by Letters Patent of the United States is:

1. A potentiostatic process for the electrodeposition of a refractory metal silicide upon the surface of an object, comprising the steps of:

preparing an essentially pure alkali fluoride melt in an inert atmosphere;

adding silicon ions to said melt in the form of silicon fluoride;

adding a refractory metal, in the form of a soluble fluoride, to said alkali fluoride melt, said refractory metal being selected from the group consisting of tantalum, titanium, tungsten, molybdenum, chromium, hafnium, niobium, and zirconium;

immersing an anode electrode into said melt;

immersing the object desired to be coated into said melt as a cathode electrode;

immersing into said melt a platinum electrode as a reference electrode; and applying a voltage across the platinum electrode and the cathode electrode until said cathode has the desired thickness of coating of said silicide of said refractory metal upon its surface.

2. The process of claim 1 wherein the anode electrode is comprised of the elemental form of the refractory metal.

3. The process of claim 2 wherein said alkali fluoride melt consists essentially of a eutectic mixture of alkali fluorides chosen from the group consisting of KF:LiF; NaF:KF; NaF:LiF; and LiF:NaF:KF

4. The process of claim 3 wherein the weight percent of silicon ions added to said melt is about 5–10 percent based on the weight of said melt.

5. The process of claim 4 wherein said alkali fluoride melt is the eutectic mixture, LiF:NaF:KF.

6. The process of claim 5 wherein said silicon fluoride is $K_2SiF_6$.

7. The process of claim 6 wherein the voltage applied across said electrodes is less than 1.2 V.

8. The process of claim 1 wherein the anode electrode is comprised of silicon.

9. The process of claim 1 wherein said refractory metal is tantalum and said metal containing compound is $K_2TaF_7$.

10. The process of claim 1 wherein said refractory metal is titanium and said metal containing compound is $K_2TiF_7$.

11. The process of claim 1 wherein said refractory metal is tungsten.

12. The process of claim 1 wherein said refractory metal is molybdenum.

13. The process of claim 1 wherein said refractory metal is chromium.

14. The process of claim 1 wherein said refractory metal is hafnium.

15. The process of claim 1 wherein said refractory metal is niobium.

16. The process of claim 1 wherein said refractory metal is zirconium.

* * * * *